United States Patent [19]

Petersson

[11] 4,142,659

[45] Mar. 6, 1979

[54] SEALING DEVICE FOR LIQUID RECEPTACLES

[75] Inventor: Bengt O. Petersson, Kungsbacka, Sweden

[73] Assignee: Aktiebolaget Svensk Rubber, Bor, Sweden

[21] Appl. No.: 819,574

[22] Filed: Jul. 27, 1977

[51] Int. Cl.[2] ..... B65D 47/06

[52] U.S. Cl. ..... 222/514; 222/525; 222/538

[58] Field of Search ..... 222/397, 514, 525, 538, 222/539, 479, 481.5, 489; 220/208, 209; 215/307

[56] References Cited

U.S. PATENT DOCUMENTS

| | | | |
|---|---|---|---|
| 2,110,026 | 3/1938 | Rose | 222/525 |
| 2,649,226 | 8/1953 | Lay | 222/539 |
| 3,297,211 | 1/1967 | Unger | 222/479 |
| 3,311,275 | 3/1967 | Gibson | 222/489 X |
| 4,022,357 | 5/1977 | Dwinell | 222/538 X |

*Primary Examiner*—John P. Shannon

[57] ABSTRACT

A receptacle for liquids, which has a portion with an opening and provided with a thread portion and a lid with a thread portion for engagement with the first said thread portion and a drawing off tube. This tube is displaceable between two positions, in one of which it extends from the opening portion into the interior of the receptacle. In the other position the tube extends from the opening portion and outwardly which is utilized in connection with drawing-off operations. The tube has a flange which is arranged in a resilient manner to change shape. It can be squeezed between an inner sealing surface of the lid and a sealing surface of the opening portion of the receptacle for liquids. Over a limited extension in connection with the removal of said surface of the lid from the sealing surface the flange can be pressed against said surface of the lid performing a sealing action and at the same time be removed from the sealing surface of the opening portion, thereby uncovering escape openings round the tube for gas under pressure.

3 Claims, 5 Drawing Figures

SEALING DEVICE FOR LIQUID RECEPTACLES

Figure 1:
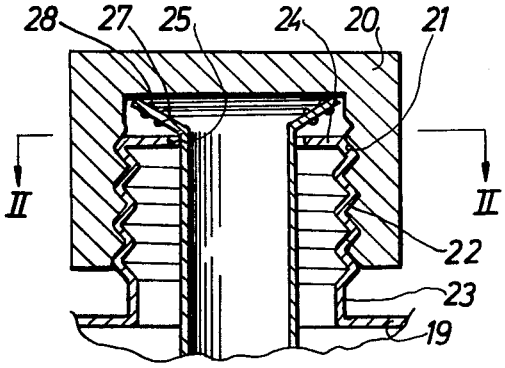

The present invention relates to a device in connection with receptacles for liquids, which have a portion with an opening and provided with a fastening portion in the form of a thread or the like, a shutting means comprising a lid or similar with an engaging portion corresponding to the fastening portion of the opening portion, and a drawing-off tube which is arranged to be displaced between two positions, in one of which it extends from the opening portion into the interior of the receptacle and in the other position it extends from the opening portion and outwards, in the latter position functioning in connection with a drawing-off operation.

During transportation and storage of receptacles for liquids of the above mentioned type the outlet tube is kept in an enclosed position in the receptacle in a space saving manner, and in its other position it facilitates the drawing off by forming a tubular piece, which projects for a distance from the receptacle. However, under unfortunate circumstances in connection with the receptacles of the prior art it can occur that the air round the outlet tube, which in the condition of transportation is submerged in the receptacle for liquids has not time to escape as quickly as is necessary upon the removal of the lid, which closes the receptacle for liquids and plugs the orifice of the tube. It can then happen that the air round the tube above the surface of the liquid in the receptacle for liquids presses out the liquid existing inside the tube, and it is desirable to prevent such a situation.

It is an object of the present invention to eliminate said risk ensure that a possible overpressure in the receptacle for liquids round the tube always will escape first of all, when removing the lid of the receptacle for liquids, before the orifice of the tube is uncovered.

The object of the present invention is attained by means of a device which is characterized by the tube having a flange which is arranged in a resilient manner to change shape in such a way that it can be squeezed between an inner sealing surface of the lid and a sealing surface of the opening portion of the receptacle for liquids, and, over a limited extension in connection with the removal of said surface of the lid from the sealing surface, be pressed against said surface of the lid performing a sealing action and at the same time be removed from the sealing surface of the opening portion, thereby uncovering escape openings round the tube for gas under pressure.

Figure 3:
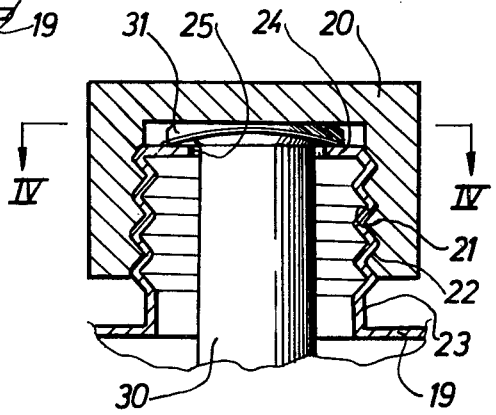
Figure 2:
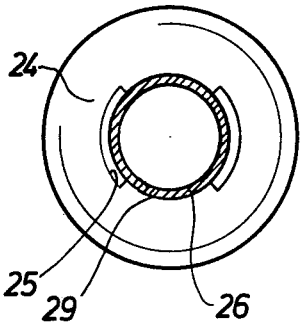
Figure 4:
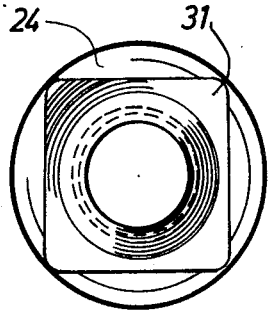
Figure 5:
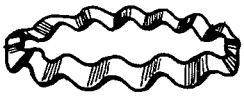

Two embodiments are illustrated in the accompanying drawing, FIG. 1 shows one of the embodiments in a cross-sectional view through the outlet portion with said tube and lid of the receptacle for liquids. In FIG. 2 the same embodiment is illustrated in a view taken at the line II—II of FIG. 1. In FIG. 3 the second embodiment is shown in a cross sectional view corresponding to the one of FIG. 1, and FIG. 4 shows a view taken at the line IV—IV of FIG. 3. FIG. 5 shows a detail forming part of the second embodiment.

Of the reference numerals shown in the FIGS. 19 is a receptacle for liquids which is only partly illustrated and by way of example can be made as a conventional emergency gasoline tank, 20 is a screw cap for the receptacle with a female thread 21, which fits a male thread 22 of an outlet portion 23 with an upper edge portion 24 defining an opening 25.

In the first embodiment the outlet tube is indicated with 26. It is made of an elastic material and has an outer flange 27 with tightening beads 28. In free condition the flange 27 has a conical shape, as is evident from FIG. 1, but the material of the tube is so resilient that if the lid 20 is tightened to its lowest position the flange 27 takes a flat shape and is squeezed between the bottom surface and the edge portion 24, the beads 28 securing a tight fit. As is evident from FIG. 2 the hole 25 which is designed with a play relative to the tube 26 can be provided with guiding portions 29, which center the tube 26.

Also in the second embodiment the tube, which in FIG. 3 is indicated with 30, is provided with an outer flange 31. In free condition it has, as is evident from FIG. 3, turned down portions, which tend to keep the flange at a distance above the edge portion 24. However, also in this case the material of the tube is so resilient that the flange can be squeezed flat between the inner axial surface of the lid and the edge portion 24, when the lid is tightened. In this position the flange 31 has a sealing effect, and for this purpose it can be provided with beads similar to the beads 28. As is shown in FIG. 4 the flange can be square, the corner portions then constituting the turned down portions. Other exterior shapes are, however, possible. When the shape is round the turned down portions take place along chords.

In order to aid the change of shape of the flanges 27 and 31 to take a shape that is not flat, a circular clip can be placed below the respective flange, by way of example an undulated spring of the kind illustrated in FIG. 5. The spring according to FIG. 5 and the respective flange must of course be designed in such a manner that the seal between the flange and the edge portion 24 is not jeopardized.

In connection with a closed receptacle for liquids, where the lid 20 is tightened and the flange 27, 31 is squeezed between the same and the edge portion 24 to a tight fit, an overpressure can exist relative to the surface of the liquid round the tube 26, 30, this due to evaporation. This overpressure can result in liquid being pressed up through the tube, when the lid is removed. However, in the present embodiment the flange 27, 31 during the first phase of unscrewing the lid will change shape, so that it maintains its seal with the lid.

In the embodiment according to FIG. 1 this change of the shape takes place by the edge of the flange 27, which in free condition is conical, by the resiliency of the tube 26 and possibly aided by the spring mentioned being pressed against the inner surface of the lid.

In the embodiment illustrated in FIG. 3 the seal is obtained by the corner portions, possibly aided by the spring mentioned, tending to lift up the tube into abutment against the lid with the inner plane portion of the flange 31.

While the seal against the lid is maintained the seal against the edge portion 24, however, will cease to exist by the change of the shape of the flange 28, 31. Thus in the first embodiment the tube 26 guided by the portion 29 of the hole 25 at the turning-up of the flange 27 will leave slits open at the edge portion 24 of the hole 25 and permit possibly existing gas under overpressure round the tube 26 to escape via said slits and further on via the thread 21, 22, which is assumed to have sufficient play for this purpose or as an alternative is provided with a groove or other connection with the surrounding atmosphere. In similar manner vents are established below the flange 31 of the second embodiment for the tube 30 having a play in the hole 25.

During the first phase of the unscrewing of the lid 20 the tube 26, 30 is maintained in a tightening condition, while the inside of the receptacle for liquids round the tube 26, 30 is vented. During a continued unscrewing also the orifice of the tube is incovered, but then there is no longer any overpressure in the receptacle for liquids, and the risk of liquid being pressed out through the tube does thus not exist any more.

The outlet tube 26 and 30 respectively of the embodiments shown is moved to a position for discharge by being pulled out to an outer position, its inner end suitably being provided with stops or arresting members which are arranged to maintain the tube in this position but in case of a great pulling force or a certain turning position the complete pulling-out of the tube will be permitted. This can also be of the type, which is turned in such a manner that the flange 27, 31 in the discharge position makes a sealing connection with the edge portion 24, the lid 20 then being divided up in a lidpart and a muff portion provided with an inward-turned flange, which is utilized also in the discharge position.

I claim:

1. A device in connection with receptacles for liquids which have a portion with a discharge opening and provided with a fastening portion, and a shutting means comprising a lid with an engaging portion corresponding to the fastening portion of the opening portion, a discharge tube which is arranged to be displaced between a first position extending from the opening portion into the interior of the receptacle and a second position extending from the opening portion and outwardly, said tube in the second position being intended to function in connection with a discharge operation, a first sealing surface arranged on the lid, and a second sealing surface arranged on the opening portion around said discharge opening, the device further comprising gas escape opening means defined by said second sealing surface and a resilient flange extending outwardly from said discharge tube, said flange in said first position of the tube being arranged to change shape between a first sealing condition in which it is squeezed between said first and second sealing surfaces and seals off said gas escape opening means when the lid is fully engaged with said opening portion and a second sealing condition over a limited extension in connection with the removal of said sealing surface of the lid from said second sealing surface in which said flange is pressed against said first sealing surface performing a sealing action and at the same time being removed from the second sealing surface, thereby uncovering said gas escape opening means around the tube for the escape of gas under pressure.

2. A device according to claim 1, wherein said first sealing surface and the second sealing surface substantially are planar, and the flange of the tube in free condition tends to assume a conical shape so that the flange with its outer edge during removal of the lid can seal against the lid at the same time it is removed from the second sealing surface located around the tube and said gas escape opening means, said flange under a flattening squeezing action being squeezed tight between said first and second sealing surfaces when the lid is in full engagement with the opening portion.

3. A device according to claim 1, wherein the flange is provided with portions tending to fold in the direction of the second sealing surface, thereby in connection with said removal of the lid under sealing action tending to press the flange against said first sealing surface while at the same time uncovering said gas escape opening means.

* * * * *